US007836634B2

(12) United States Patent
Bigourden

(10) Patent No.: US 7,836,634 B2
(45) Date of Patent: Nov. 23, 2010

(54) WINDOW REGULATOR RAIL ASSEMBLY AND METHOD OF MOUNTING A WINDOW REGULATOR RAIL

(75) Inventor: Jean-Francois Bigourden, Neudorf-Platendorf (DE)

(73) Assignee: ArvinMeritor GmbH, Dietzenbach (DE)

( * ) Notice: Subject to any disclaimer, the term of this patent is extended or adjusted under 35 U.S.C. 154(b) by 1312 days.

(21) Appl. No.: 11/358,344

(22) Filed: Feb. 21, 2006

(65) Prior Publication Data

US 2006/0185247 A1 Aug. 24, 2006

(30) Foreign Application Priority Data

Feb. 22, 2005 (DE) ..... 10 2005 008 080

(51) Int. Cl.
*E05F 11/38* (2006.01)

(52) U.S. Cl. ..... 49/348; 49/349; 49/502

(58) Field of Classification Search ..... 49/348, 49/349, 352, 502
See application file for complete search history.

(56) References Cited

U.S. PATENT DOCUMENTS 2,449,210 A * 9/1948 Faust ..... 49/452
4,956,942 A * 9/1990 Lisak et al. ..... 49/502
5,457,912 A * 10/1995 Yates et al. ..... 49/374
6,029,403 A * 2/2000 Bertolini et al. ..... 49/502
6,425,204 B1 * 7/2002 Renner ..... 49/213
6,425,208 B1 * 7/2002 Klueger et al. ..... 49/502
2003/0131534 A1 * 7/2003 Cardine et al. ..... 49/212
2004/0074149 A1 * 4/2004 Tatsumi et al. ..... 49/352
2005/0155290 A1 * 7/2005 Cardine et al. ..... 49/352
2006/0254146 A1 * 11/2006 Florentin et al. ..... 49/349
2006/0283088 A1 * 12/2006 Buchta ..... 49/352
2007/0214726 A1 * 9/2007 Graf et al. ..... 49/352
2008/0148647 A1 * 6/2008 Pavlovic ..... 49/502
2008/0276541 A1 * 11/2008 Roy et al. ..... 49/502

* cited by examiner

*Primary Examiner*—Gregory J. Strimbu
(74) *Attorney, Agent, or Firm*—Carlson, Gaskey & Olds

(57) ABSTRACT

A window regulator rail, in particular for a motor vehicle, includes a mounting portion and a fastening bolt. The fastening bolt includes an attachment collar and first and second fastening portions that are arranged on opposite sides of the attachment collar. The fastening bolt is releasably and adjustably attached to the mounting portion of the window regulator rail in a predefined position by the first fastening portion. On the second fastening portion, a fastening member is arranged in a mounting position. The fastening bolt allows adjustment of the window regulator rail as needed.

19 Claims, 3 Drawing Sheets

WINDOW REGULATOR RAIL ASSEMBLY AND METHOD OF MOUNTING A WINDOW REGULATOR RAIL

RELATED APPLICATIONS

The application claims priority to German Application No. 10 2005 008 080.4, which was filed on Feb. 22, 2005.

BACKGROUND OF THE INVENTION

This invention relates to a window regulator rail, in particular for a motor vehicle, and to a mounting of the window regulator rail on the motor vehicle.

A carriage is mounted on the window regulator rail. An adjustable window or other components of a window regulator are accommodated in the carriage. For a vehicle manufacturer who will mount the window regulator in a vehicle, the window regulator rail is supplied to an assembly line preassembled as much as possible, so that minimal effort can be used to mount the window regulator in the vehicle.

A commonly used way of mounting a window regulator rail includes screwing the window regulator rail to a mounting lug that is provided on the vehicle for mounting the window regulator rail. For this purpose, a bore is provided in the window regulator rail and the mounting lug, which bore constitutes an elongated hole in one of the window regulator rail and mounting lug. This provides for a precise alignment of the window regulator rail during installation.

One disadvantage with this mounting method is that the window regulator rail must be aligned during assembly and a separate screw must be supplied to an assembly line.

SUMMARY OF THE INVENTION

It is the object of the invention to create a window regulator rail, as well as an assembly including a window regulator rail and mounting lug, which considerably simplifies the assembly.

For this purpose, a window regulator rail for a motor vehicle includes a mounting portion and a fastening bolt. The fastening bolt includes an attachment collar and first and second fastening portions that are arranged on opposite sides of the attachment collar from each other. The fastening bolt is releasably and adjustably attached to the mounting portion of the window regulator rail in a predefined position by the first fastening portion. On the second fastening portion, a fastening member is arranged in a mounting position.

With the subject window regulator rail, all requirements can be satisfied at once. On the one hand, the position and alignment, in which the window regulator rail is mounted in the vehicle, can be specified precisely because the fastening bolt can be attached to the mounting portion of the window regulator rail in a nominal position. This nominal position corresponds to a constructionally specified position, which the fastening bolt must assume theoretically, to ensure that the window regulator rail is mounted in the vehicle in the desired position and alignment. Since the inevitable manufacturing tolerances are distributed around the nominal position in the manner of a Gaussian curve, it can be expected for the majority of the window regulator rails that the fastening bolt is "correctly" arranged in the nominal position. In the few cases in which a readjustment is required, the readjustment can be made, as the fastening bolt is releasably and adjustably attached to the mounting portion. On the other hand, it is not necessary to provide a separate component at the assembly line for the window regulator rail, as the necessary fastening member for mounting on the mounting lug is already part of the second fastening portion.

Preferably, the mounting portion includes an elongated hole that receives the first fastening portion. This provides for shifting the fastening bolt within limits provided by the elongated hole, so that the fastening bolt can take either the nominal position or, in the case of a readjustment, an individually determined position.

In accordance with the preferred embodiment, it is provided that the first fastening portion is a threaded bolt with a first nut screwed onto the threaded bolt. This provides a low manufacturing and mounting effort.

Preferably, the first nut is non-rotatably held at the mounting portion. For instance, an outside surface of the first nut rests against a contact surface of the mounting portion. In this case, no additional measures must be taken to prevent the first nut from rotating when the fastening bolt is mounted at the mounting portion. The first nut could be a square nut or a hexagonal nut, which rests against a bent tab of the mounting portion at the outside surface. A square nut provides a low piece cost.

In accordance with the preferred embodiment, the second fastening portion is also a threaded bolt with a second nut screwed onto the threaded bolt. This provides for adjustably mounting the window regulator rail and the fastening bolt at the mounting lug in the vehicle with little effort.

Preferably, the second nut is a self-locking nut. The advantage is that the second nut captively remains in the mounting position, i.e. in that position in which the second fastening portion of the fastening bolt can loosely be inserted into the mounting lug. In other words, the second nut is screwed onto the second fastening portion just so far such that an associated locking ring will bite, and the second nut cannot be released from the second fastening portion during the transport of the preassembled window regulator rail. Only during the assembly of the window regulator rail in the vehicle will the second nut then be screwed further onto the second fastening portion, until the second nut fixes the window regulator rail at the mounting lug. The term "self-locking nut" is also meant to include an assembly including a nut and a separate locking member that prevents the nut from being released due to vibrations, etc.

In accordance with the preferred embodiment of the invention, the second fastening portion is provided with an engagement portion for a tool at an end facing away from the attachment collar. The engagement portion constitutes a square or hexagon, for example. On the one hand, this provides for retaining the fastening bolt to prevent the fastening bolt from rotating when the second nut on the second fastening portion is tightened. On the other hand, the engagement portion provides for rotating the fastening bolt. As a result, the first fastening portion can be screwed into the first nut when the fastening bolt is mounted for instance in the nominal position, or can slightly be screwed out of the first nut, in order to bring the fastening bolt from the nominal position into an individually determined position, and can then be re-tightened in the first nut.

The above-mentioned object is also solved by an assembly including a window regulator rail, as mentioned above, and a mounting lug that is mounted on the vehicle. The mounting lug includes a positioning configuration, preferably formed by an indentation, in which the attachment collar is at least partly received. As a positioning configuration, the indentation provides for an automatic positioning of the fastening bolt at the mounting lug and hence for the correct alignment of the window regulator rail in the vehicle. The actual adjustment of the correct position has already been accomplished before the assembly because the fastening bolt was mounted on the mounting portion of the window regulator rail in the nominal position. During the actual assembly of the window regulator rail, no further steps must be taken. Apart from the positioning of the window regulator rail during the assembly, the positioning configuration also has another function. The positioning configuration ensures that the correct position of the window regulator rail is maintained even if the second nut should loosen in operation. Even if the second nut is not completely tightened, the attachment collar cannot leave the indentation. This is only possible after the second nut has been screwed down very far from the second fastening portion.

Preferably, both the indentation and the attachment collar are circular. This ensures that the attachment collar can be received in the indentation independent of an associated rotary position.

Preferably, the attachment collar is bevelled towards the second fastening portion. This facilitates the positioning of the attachment collar of the fastening bolt in the indentation, and the attachment collar acts in the manner of an inlet bevel.

In accordance with the preferred embodiment, the mounting lug has a slot that ends in a middle of the indentation. The fastening bolt is simply laterally inserted into the mounting lug until the attachment collar lies in the indentation. Then, it is only necessary to tighten the second nut, and the window regulator rail is mounted precisely and reliably.

The above-mentioned object is also solved by a method for mounting a component, in particular for mounting a window regulator rail in a vehicle, which includes the following steps: A fastening bolt is releasably mounted to the component in a nominal position. Then, the component together with the fastening bolt, is mounted in the vehicle, the fastening bolt automatically defining the mounting position of the component. Subsequently, the fastening bolt is attached to the vehicle. Thereupon, it is checked whether the nominal position of the component complies with a geometry of the vehicle. If the position of the component does not comply with the geometry of the vehicle, the fastening bolt is released from the component, the component is adjusted, and the fastening bolt is firmly re-mounted to the component. The particular advantage of this method is, for a majority of the mounted components, such as window regulator rails, the position of the component in the vehicle can already be precisely defined before the actual assembly, while the position nevertheless can newly be adjusted at a later date if necessary. Moreover, reference is made to the advantages mentioned above with respect to the window regulator rail.

These and other features of the present invention can be best understood from the following specification and drawings, the following of which is a brief description.

DETAILED DESCRIPTION OF THE PREFERRED EMBODIMENT

Figure 1:
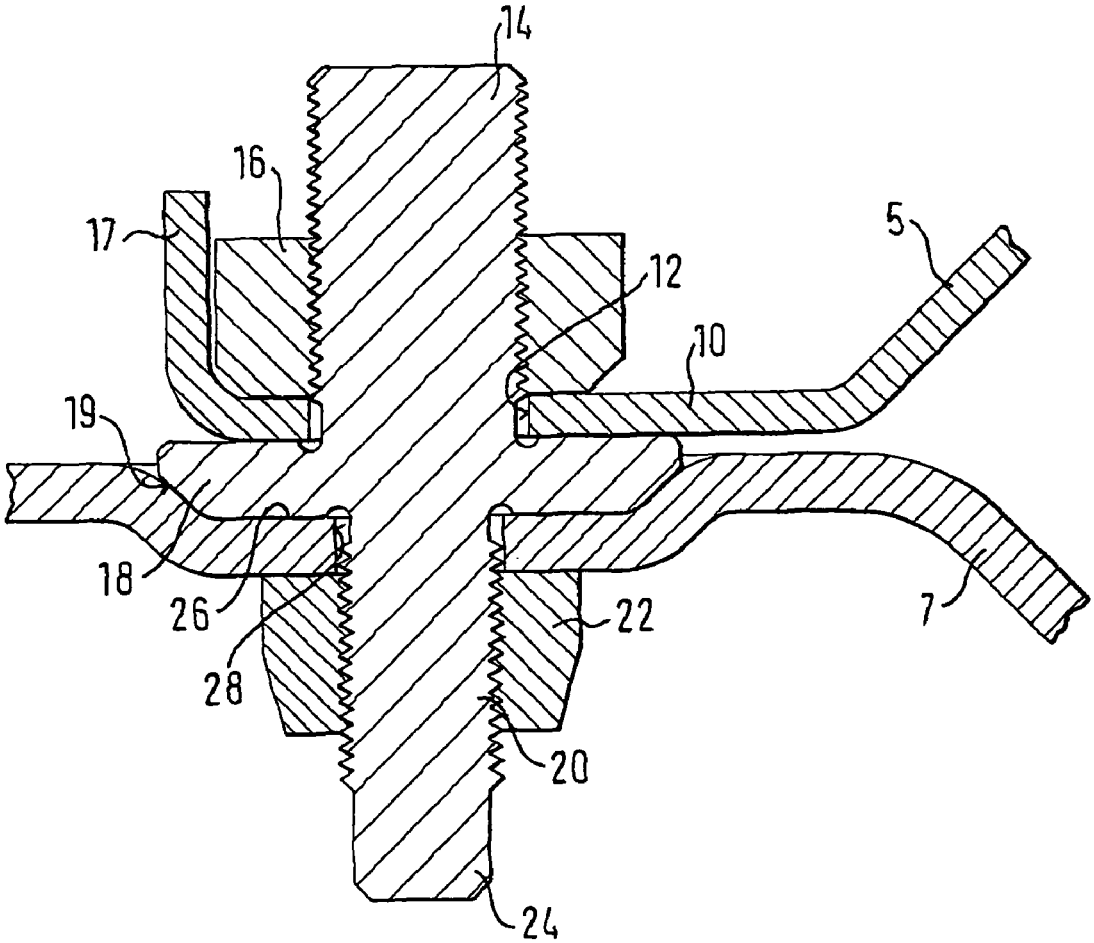
FIG. 1 shows a cross-sectional view of a window regulator rail of the invention, which is mounted on a mounting lug in a vehicle.
Figure 2:
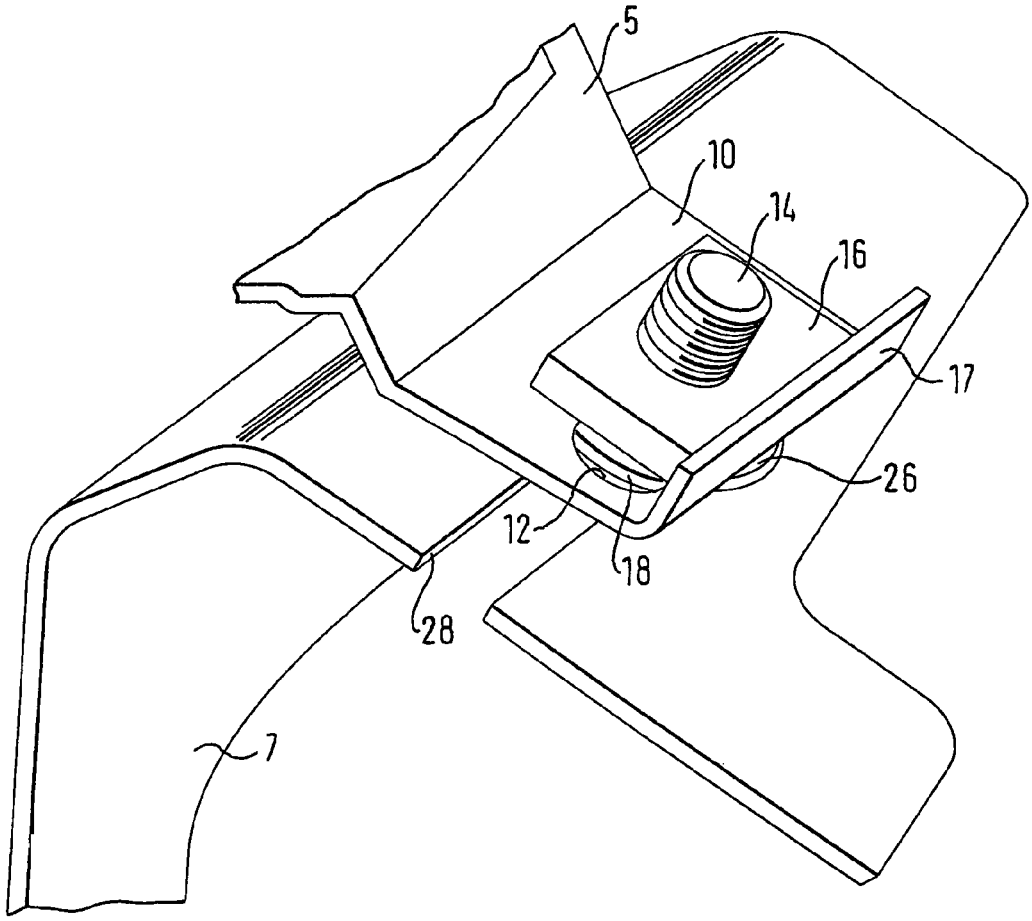
FIG. 2 shows the mounted window regulator rail in a first perspective view.
Figure 3:
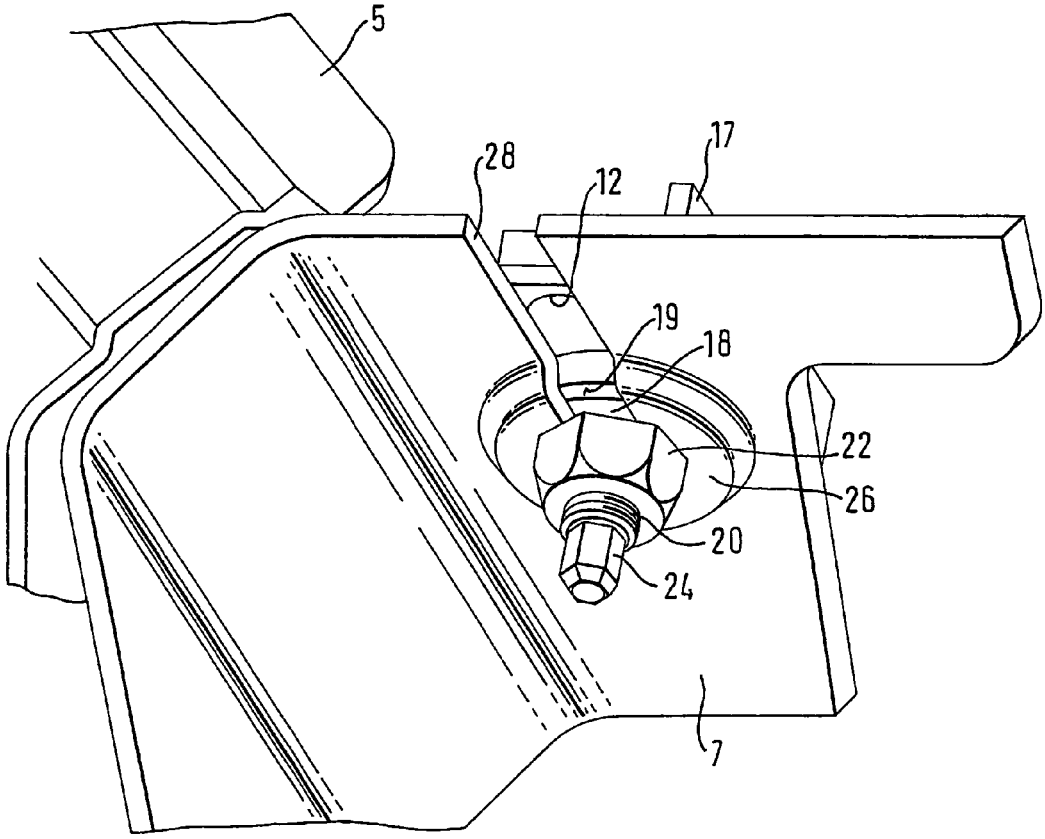
FIG. 3 shows the mounted window regulator rail in a second perspective view.

In FIGS. 1-3, a portion of a window regulator rail 5 is shown, which is mounted on a mounting lug 7. The window regulator rail 5 is shown in a cross-sectional view with one end of the window regulator rail being cut-off. Only a mounting portion 10 of the window regulator rail 5 is relevant for understanding of the invention. The mounting portion 10 is positioned at one end of the window regulator rail 5. The mounting lug 7 is also shown in a cut-off cross-sectional view; the way in which the mounting lug 7 is mounted in a vehicle, and where the mounting lug 7 is mounted, are not relevant for the understanding of the invention.

The mounting portion 10 includes an elongated hole 12, which in the illustrated embodiment extends approximately parallel to a lower edge of the window regulator rail 5. A first threaded bolt 14 with a first nut 16 screwed onto the first threaded bolt 14 extends through the elongated hole 12. The first nut 16 is a square nut and rests against a bent edge portion 17 of the mounting portion 10 at one outside surface.

The first threaded bolt 14 is integrally formed with an attachment collar 18, which has a circular outer contour. A second threaded bolt 20 is also integrally formed with the attachment collar 18. The second threaded bolt 20 has a second nut 22 screwed onto the second threaded bolt 20, which constitutes a self-locking nut. On a side facing the second threaded bolt 20, the attachment collar 18 has a circumferential bevel 19.

The first threaded bolt 14, the second threaded bolt 20, and the attachment collar 18 have a rotationally symmetrical design and are arranged coaxially. Together, they form a fastening bolt that includes a first fastening portion, which is associated with the mounting portion 10, and a second fastening portion, which is associated with the mounting lug 7.

At a free end, the second threaded bolt 20 has an engagement portion 24 that constitutes a hexagon shape. The function of the engagement portion 24 will be explained below.

The mounting lug 7 includes a positioning portion in the form of an indentation 26, which has a circular contour and is designed as an embossed portion. In the illustrated embodiment, a depth of this embossed portion is approximately equal to a wall thickness of the mounting lug 7. Proceeding from a bottom of the indentation 26, an inclined transitional portion extends up to an outside surface of the mounting lug 7. From an edge of the mounting lug 7, a slot 28 leads to a middle of the indentation 26. The width of the slot 28 is slightly larger than a diameter of the second threaded bolt 20.

The fastening bolt is mounted at the mounting portion 10 by introducing the first threaded bolt 14 through the elongated hole 12 and screwing the first threaded bolt 14 into the first nut 16, so that the mounting portion 10 is clamped between the first nut 16 and the attachment collar 18. The first nut 16 cannot rotate when the first threaded bolt 14 is screwed in, as the first nut 16 is non-rotatably held by the bent edge portion 17. The required tightening torque is applied by a tool that is placed onto the engagement portion 24. When the fastening bolt is tightened, it is held in a nominal position which corresponds to that position which it should take in accordance with constructional specifications to ensure that the window regulator rail 5 assumes a required position and alignment in the vehicle. The second nut 22 is loosely screwed onto the second threaded bolt 20 merely to an extent that an associated locking ring will bite and the second nut 22 is captively retained.

The window regulator rail 5, preassembled as described below, is mounted in the vehicle by inserting the second threaded bolt 20 into the slot 28 of the mounting lug 7, until the attachment collar 18 comes to lie in the indentation 26. The bevel 19 of the attachment collar 18 and the inclined transitional portion of the indentation 26 facilitate the positioning of the attachment collar 18 in the indentation 26.

When the attachment collar 18 is arranged in the indentation 26, the second nut 22 is tightened until the mounting lug 7 is clamped between the attachment collar 18 and the second nut 22.

If it turns out that the window regulator rail 5 is not positioned correctly, although the fastening bolt and hence also the window regulator rail 5 are in the nominal position, the second nut 22 can be released again, the fastening bolt can slightly be screwed out of the first nut 16, the window regulator rail 5 can be positioned correctly, and then the fastening bolt and the second nut 22 can be re-tightened.

The cooperation of attachment collar 18 and indentation 26 ensures that the fastening bolt also remains correctly positioned in the indentation 26 when the second nut 22 has not been tightened properly. The attachment collar 18 can only leave the indentation 26 when the second nut 22 has been screwed off very far from the second threaded bolt 20. This increased constructional safety could possibly eliminate the need for a self-locking nut, and a conventional nut could be used instead.

The window regulator rail and the mounting thereof as described above are particularly useful for frameless doors of a motor vehicle, in which lowerable windows are not guided in a door frame above a door parapet, but only inside the door parapet. In the case of frameless doors, a particularly high rigidity and precise positioning of the window regulator rails are particularly important, as otherwise the window cannot reliably be urged against an associated seal at a vehicle roof.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A window regulator rail assembly for a motor vehicle comprising:

window regulator rail with a mounting portion, the mounting portion including an elongated hole;

a fastening bolt including an attachment collar, a first fastening portion arranged on one side of the attachment collar and a second fastening portion arranged on a side of the attachment collar opposite said first fastening portion, wherein the first fastening portion is a threaded bolt with a nut screwed onto the threaded bolt, the nut being non-rotatably held by the mounting portion, and wherein the first fastening portion is received within the elongated hole; a mounting lug with an elongated slot and a generally circular indentation, the elongated slot terminating at one end thereof generally at a center of the indentation, the second fastening portion extending through the elongated slot; and wherein the fastening bolt is releasably and adjustably attached to the mounting portion of the window regulator rail by the first fastening portion, and wherein the second fastening portion includes a fastener that is arranged in a mounting position.

2. The window regulator rail assembly as claimed in claim 1 wherein an outside surface of the nut abuts against a contact surface of the mounting portion.

3. The window regulator rail assembly as claimed in claim 1 wherein the nut is a square nut.

4. The window regulator rail assembly as claimed in claim 1 wherein the second fastening portion is a threaded bolt with said fastener screwed onto the threaded bolt of the second fastening portion.

5. The window regulator rail assembly as claimed in claim 4 wherein the nut is a self-locking nut.

6. The window regulator rail assembly as claimed in claim 1 wherein the second fastening portion includes an engagement portion for a tool, the engagement portion being located at an end of the second fastening portion facing away from the attachment collar.

7. The window regulator rail assembly as claimed in claim 6 wherein the engagement portion has one of a square and hexagon shape.

8. The window regulator rail assembly as claimed in claim 1 wherein the attachment collar has a circular outer contour.

9. The window regulator rail assembly as claimed in claim 8 wherein the attachment collar is bevelled towards the second fastening portion.

10. The window regulator rail assembly as claimed in claim 1 wherein the second fastening portion is a second threaded bolt with said fastener screwed onto the second threaded bolt, and with the first fastening portion, the second fastening portion and the attachment collar being integrally formed together as a single-piece component.

11. The window regulator rail assembly as claimed in claim 1 wherein the mounting portion transitions into a bent-edge portion and wherein the nut is non-rotatably held against the bent edge portion.

12. The window regulator rail assembly as claimed in claim 1 wherein the threaded bolt with the mounting portion is directly clamped between the first nut and the attachment collar and the mounting lug is directly clamped between the attachment collar and the fastener.

13. A window regulator rail assembly for a motor vehicle comprising:

a window regulator rail including a mounting portion having a non-threaded elongated hole, a fastening bolt including an attachment collar, a first fastening portion arranged on one side of the attachment collar and a second fastening portion arranged on a side of the attachment collar opposite said first fastening portion, wherein the fastening bolt is releasably and adjustably attached to the mounting portion of the window regulator rail by the first fastening portion, and wherein the second fastening portion includes a fastener that is arranged in a mounting position, and wherein the first fastening portion comprises a first threaded bolt portion extending through the elongated hole and a nut screwed onto the first threaded bolt portion, the nut being non-rotatably held at the mounting portion; and a mounting lug adapted for mounting on the motor vehicle, the mounting lug including an elongated slot and a generally circular indentation, the elongated slot terminating at one end thereof generally at a center of the indentation, the second fastening portion extending through the elongated slot.

14. The window regulator rail assembly as claimed in claim 13 wherein the indentation that at least partly receives the attachment collar, and wherein the mounting has a first surface facing the first fastening portion and a second surface facing the second fastening portion, the indentation being formed within the first surface to have a generally flat recessed base and a circumferential beveled side wall transitioning from the flat recessed base to the first surface.

15. The window regulator rail assembly as claimed in claim 14 wherein the attachment collar includes a beveled surface cooperating with the circumferential beveled side wall of the indentation to locate the fastening bolt within the mounting lug.

16. The window regulator rail assembly as claimed in claim 13 wherein the attachment collar is selectively movable relative to the mounting portion to adjust a position of the window regulator rail relative to said mounting lug such that when the rail assembly is in a final installed condition, the attachment collar is clamped directly against the mounting portion by the nut and the attachment collar is clamped directly against the mounting lug by the fastener.

17. The window regulator rail assembly as claimed in claim 16 wherein the slot has a width that is greater than a diameter of the second fastening portion.

18. The window regulator rail assembly as claimed in claim 13 wherein a width of the elongated hole is greater than a diameter of the first.

19. A window regulator rail assembly for a motor vehicle comprising:

a window regulator rail including a mounting portion, and a fastening bolt including an attachment collar, a first fastening portion arranged on one side of the attachment collar and a second fastening portion arranged on a side of the attachment collar opposite said first fastening portion, wherein the fastening bolt is releasably and adjustably attached to the mounting portion of the window regulator rail by the first fastening portion, and wherein the second fastening portion includes a fastener and is arranged in a mounting position;

wherein the first fastening portion is a threaded bolt with a nut screwed onto the threaded bolt, and wherein the mounting portion transitions into a bent-edge portion and wherein the nut is non-rotatably held against the bent edge portion, and wherein the attachment collar is selectively movable relative to the mounting portion to adjust a position of the window regulator rail relative to a mounting lug; and said mounting lug adapted for mounting on the motor vehicle, the mounting lug including a positioning configuration that defines the mounting position of the second fastening portion and wherein the mounting lug includes a slot through which the second fastening portion extends such that when in a final installed condition the attachment collar is clamped directly against the mounting portion by the nut and the attachment collar is clamped directly against the mounting lug by the fastener.

* * * * *